US005218156A

United States Patent [19]

Ilzuka et al.

[11] Patent Number: 5,218,156

[45] Date of Patent: Jun. 8, 1993

[54] APPARATUS FOR COMBINING STORED WAVEFORMS TO SYNTHESIZE MUSICAL TONES

[75] Inventors: Akira Ilzuka; Kenji Kawakami, both of Hamamatsu, Japan

[73] Assignee: Yamaha Corporation, Hamamatsu, Japan

[21] Appl. No.: 671,358

[22] Filed: Mar. 19, 1991

[30] Foreign Application Priority Data

Mar. 20, 1990 [JP] Japan ..... 2-70503

[51] Int. Cl.[5] ..... G10H 5/02

[52] U.S. Cl. ..... 84/624; 84/659; 84/694; 84/DIG. 10

[58] Field of Search ..... 84/624, 659, 694–696, 84/DIG. 10

[56] References Cited

U.S. PATENT DOCUMENTS 4,249,447 2/1981 Tomisawa ..... 84/605
4,297,933 11/1981 Nishimoto ..... 84/607
4,554,857 11/1985 Nishimoto ..... 84/624
4,643,066 2/1987 Oya ..... 84/624

FOREIGN PATENT DOCUMENTS 63-22319 5/1988 Japan .

*Primary Examiner*—William M. Shoop, Jr.
*Assistant Examiner*—Brian Sircus
*Attorney, Agent, or Firm*—Graham & James

[57] ABSTRACT

A musical tone synthesizing apparatus comprising FM operators and connection control device. At least one of the FM operators comprises a waveform memory, phase data generation device, and output inversion device. The waveform memory stores fundamental waveform data. The phase data generation device generates phase data as an address signal for accessing the waveform memory on the basis of a musical tone designation signal and a modulation signal inputted from an external circuit. The output inversion device selects whether a waveform signal read out from the waveform memory is outputted after sign inversion, or is outputted directly. The connection control device arbitrarily combine connections of the FM operators.

18 Claims, 4 Drawing Sheets

APPARATUS FOR COMBINING STORED WAVEFORMS TO SYNTHESIZE MUSICAL TONES

BACKGROUND OF THE INVENTION

1. Field of the Invention

The present invention relates to a musical tone generation apparatus applied to a frequency modulation technology in an electronic musical instrument.

2. Description of the Prior Art

Conventionally, an FM operator as a sound source utilizing a frequency modulation system generates many partial tones or harmonic overtones by arithmetic operations of simple equations, and is widely known as one effective method of synthesizing percussion tones, and wind instruments tones, and the like. In this FM operator, a waveform memory storing waveform data of musical tone signals is accessed by an address signal of a desired repeating frequency to read out waveform data, and a musical tone signal is generated based on the readout waveform data.

As a developed type of this FM operator, an operator which feeds back an amplitude value of readout waveform data to an address input of a waveform memory at a proper feedback rate to modulate a read address, thereby obtaining various waveforms, a sawtooth waveform, for example, different from the waveform data stored in the waveform memory is known (Japanese Patent Publication No. Sho 61-20875).

In addition, a musical tone signal forming apparatus which prepares various frequency modulation algorithms (combinations of modulations and additions among operators) to obtain a variety of musical tones, and time-divisionally shares one fundamental waveform memory to be able to perform arithmetic operations for a plurality of operators is also disclosed (Japanese Patent Publication No. Sho 64-4199).

However, in the above-mentioned prior arts, when processing for, e.g., removing some harmonic overtones from a musical tone generated by a given FM term (a combination of a carrier and a modulator) is to be executed, a filter must be separately used. When musical tones are synthesized by selecting a proper algorithm, depending on the frequency relationship of operators, a musical tone having a rectangular waveform can be obtained, but it is difficult to change the rate of the rectangular width in one cycle of the waveform. Moreover, it is difficult to modulate the rectangular width. Generally, such modulation is called PWM (Pulse Width Modulation).

SUMMARY OF THE INVENTION

It is an object of the present invention to provide a musical tone generation apparatus using an FM operator, which apparatus can easily obtain a musical tone waveform signal which is difficult to obtain in a conventional system in consideration of the problems of the prior arts described above.

In order to achieve the above object, a musical tone generation apparatus according to the present invention comprises a plurality of FM operators each comprising a waveform memory for storing fundamental waveform data of musical tones to be generated, phase data generation means for generating phase data as an address signal for accessing the waveform memory on the basis of a musical tone designation data signal and a modulation signal which are inputted from an external circuit, and output inverting means which can select whether a waveform signal read out from the waveform memory in accordance with the phase data is outputted after sign inversion, or is directly outputted; and connection control means for arbitrarily combining connections of the plurality of FM operators.

In general, connections of the plurality of FM operators include one or more connections by addition means for adding outputs from the FM operators and outputting a sum, and one or more connections by addition means for adding an output from a given FM operator to phase data of another operator, and modulating the phase data. Thus, the connection control means selects addition means for attaining desired connections among the FM operators to combine the connections among the FM operators.

In the above arrangement, if the sign of a signal outputted from a given FM operator is inverted and an output from another operator is not inverted, when these signals are added, corresponding frequency components cancel each other. Therefore, when output characteristics of the two signals are appropriately set, various changes in tone color can be given to musical tone signals obtained by adding these signals.

For example, if sawtooth waveforms which are inverted to each other are set to be outputted as two outputs added by addition means, a PWM waveform can be obtained as a sum output of these waveforms. Since corresponding frequency components cancel each other, a given FM operator often serves as a filter for a given frequency component of an output from another operator.

Other features and advantages of the invention will be apparent from the following detailed description.

DETAILED DESCRIPTION OF THE PREFERRED EMBODIMENTS

An embodiment of the present invention will be described below with reference to the accompanying drawings.

Figure 1:
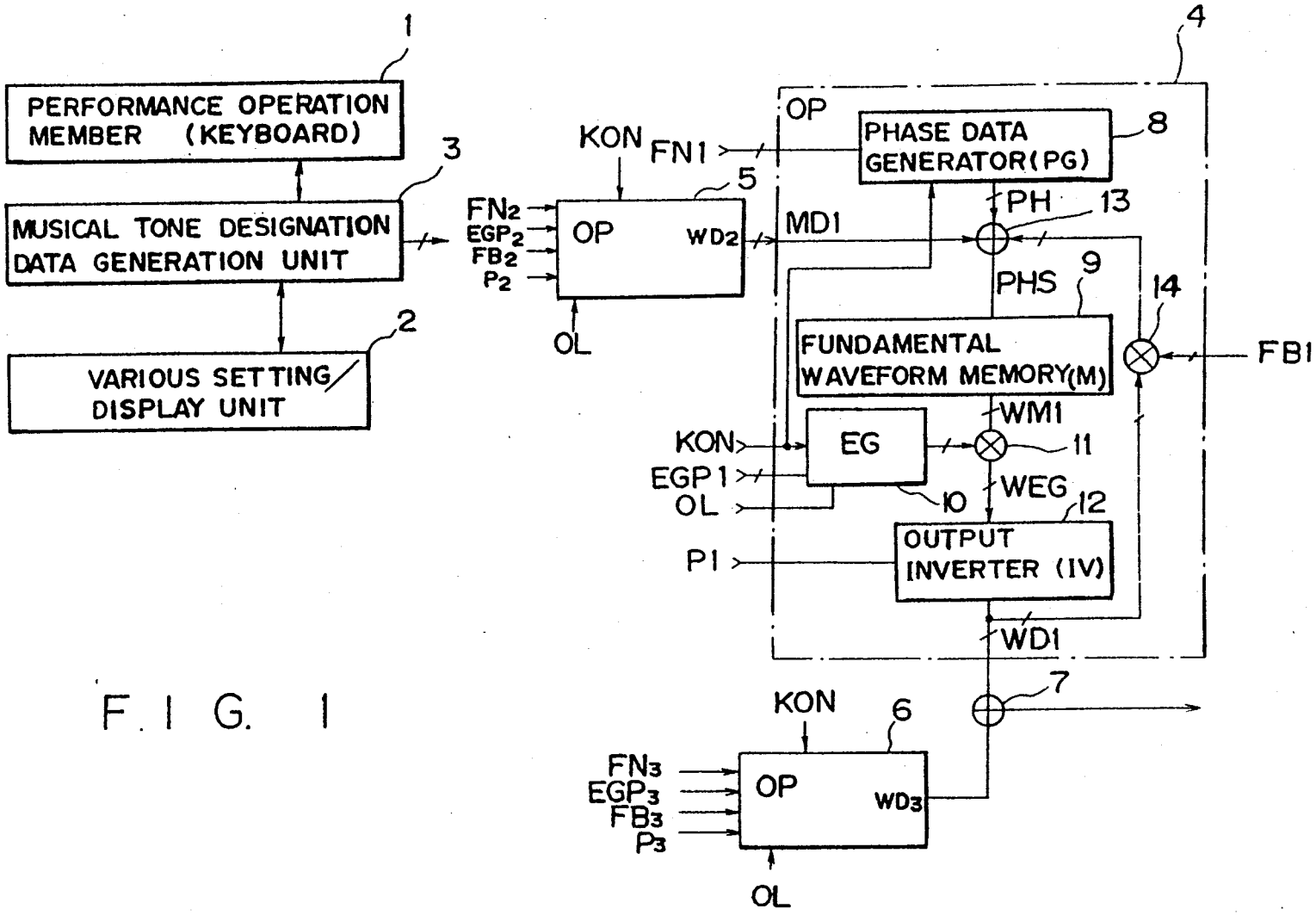
FIG. 1 is a block diagram showing an arrangement of an electronic musical instrument comprising a musical tone synthesizing apparatus according to an embodiment of the present invention.

FIG. 1 is a block diagram showing an arrangement of an electronic musical instrument comprising a musical tone generation apparatus according to an embodiment of the present invention. The electronic musical instrument employing an FM algorithm by a parallel dual-system arrangement comprises a performance operation member 1 having, e.g., a keyboard, a various setting-/display unit 2 for setting and displaying, e.g., tone colors of musical tones, a musical tone designation data generation unit 3 for generating a musical tone designation data signal on the basis of an operation of the performance operation member 1 and setting data of the various setting/display unit 2, three FM operators 4 to 6 for generating and outputting musical tone signals, and the like on the basis of the musical tone designation data signal, and an adder 7 for adding outputs from the operators 4 and 6, and outputting the sum. The musical tone designation data signal includes a key ON signal KON indicating a key ON event at the keyboard, frequency numbers FN1 to FN3 of the operators 4 to 6, which correspond to a frequency of an ON key, various parameters EGP1 to EGP3 associated with envelope waveforms in the operators 4 to 6, an out level OL for determining an amplitude level of an output from each operator, feedback rates FB1 to FB3 of the operators 4 to 6, and signals P1 to P3 indicating whether or not outputs from the operators 4 to 6 are to be inverted.

The operator 4 comprises a phase data generator 8 for outputting phase data PH which sequentially changes at a predetermined interval on the basis of the key ON signal KON and the frequency number FN1, a fundamental waveform memory 9, addressed by the phase data PH, for sequentially outputting waveform levels of corresponding phase portions, an envelope generator 10 for outputting EG signals to be multiplied with the waveform levels of the phase portions sequentially outputted from the memory 9 on the basis of the key ON signal KON, the parameter signal EGP1, and the level signal OL, a multiplier 11 for multiplying an output from the memory 9 with an output from the envelope generator 10, and outputting a product, an output inverter 12 for inverting and outputting an output from the multiplier 11 on the basis of the signal P1 (when P1=1), or directly outputting it (when P1=0), an adder 13, inserted between the phase data generator 8 and the memory 9, for feeding back an output from the output inverter 12, and a multiplier 14, inserted between the output inverter 12 and the adder 13, for multiplying the feedback rate signal FB1 with an output from the output inverter 12 to set a feedback rate.

The operators 5 and 6 also have the same arrangement as the operator 4. Note that the operator 5 serves as a modulator for the operator 4, and the operator 4 serves as a carrier generator for the modulator. More specifically, an output from the operator 5 is inputted to the adder 13 of the operator 4 as a modulation waveform MD1, and the phase data PH in the operator 4 is further modulated based on this waveform.

With this arrangement, when an arbitrary key of the performance operation member 1 is depressed, musical tone designation data corresponding to the ON key is outputted from the musical tone designation data generator 3, and phase data is outputted from the phase data generator 8 on the basis of the key ON signal KON and the frequency number FN1 of the ON key. The phase data is inputted to the adder 13 as a phase input variable PH. The output from the output inverter 12 is also fed back to the adder 13 via the multiplier 14 for multiplying a feed back coefficient FB1. In addition, the modulation signal MD1 from the operator 5 is also inputted to the adder 13. Read access of the fundamental waveform memory (normally, a sine wave memory) 9 is performed based on an output signal PHS from the adder 13 obtained by adding these inputs. A readout waveform signal WM1 is multiplied with envelope data from the envelope generator 10 by the multiplier 11 to obtain a signal WEG, and the signal WEG is inputted to the output inverter 12. If the inversion output signal P1 is at logic "1", a signal WD1 obtained by inverting the signal WEG is outputted from the output inverter 12. If the signal Pl is at logic "0", the signal WEG is directly outputted as the signal WD1.

For example, when the fundamental waveform memory 9 comprises a sine wave memory, the signal P1 is "1" (inverting operation), a feedback amount is FB1, an output from the envelope generator 10 is "1", and the output MD1 from the operator 5 is 0, the phase input PHS (output from the adder 13) of a musical waveform -sin(PHS) to be obtained is expressed as a function of the phase input variable PH:

$$\begin{aligned} PHS &= PH + (-1)\cdot FB1\cdot \sin(PHS) \\ &= PH + FB1\cdot \sin(PHS - \pi) \end{aligned}$$

Therefore, this equation can be rewritten as:

$$(\mathrm{PHS}-\pi)=(\mathrm{PH}-\pi)+\mathrm{FB1}\cdot\sin(\mathrm{PHS}-\pi)$$

It is demonstrated based on an analysis result of this equation that a musical waveform WD1 to be obtained is expressed as:

$$\begin{aligned} WD1 &= -\sin(PHS) \\ &= \sin(PHS - \pi) \\ &= \Sigma\{2/(n\cdot FB1)\}\cdot J_n(n\cdot FB1)\cdot \sin\{n\cdot(PH-\pi)\} \end{aligned}$$

Figure 2:
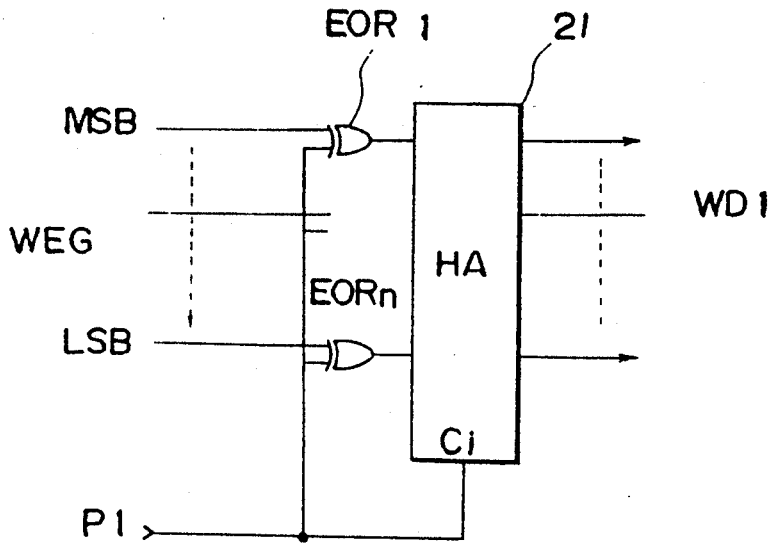
FIGS. 2 and 3 are circuit diagrams showing detailed arrangements of an output inverter of the apparatus shown in FIG. 1.
Figure 3:
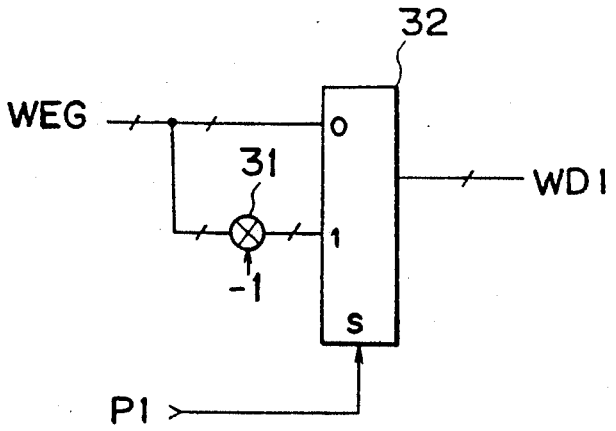

Note that $J_n(n\cdot FB1)$ is a Bessel function where n is the order number and (n·FB1) is the modulation index. FIGS. 2 and 3 are circuit diagrams respectively showing detailed arrangements of the output inverter 12.

In FIG. 2, each of n EX-OR gates EORl to EORn receives the inversion output signal P1 at one input, and receives a corresponding bit of n-bit data of the signal WEG from the multiplier 11 at the other input. The outputs from the EX-OR gates EORl to EORn are connected to a half adder 21. The half adder 21 receives the inversion output signal P1 at its carry-in terminal. Therefore, when the inversion output signal P1 is "1", bits of n-bit data expressed as a complementary number of 2 are inverted by the corresponding EX-OR gates EORl to EORn, and are inputted to the half adder 21. In addition, "1" of the inversion output signal P1 is added to the input data. As a result, data WD1 whose sign is inverted is outputted from the half adder 21. When the inversion output signal is "0", the signal WEG is directly outputted as the signal WD1.

In FIG. 3, data as the signal WEG itself and data multiplied with "−1"by a multiplier 31 are inputted to a selector 32. When the inversion output signal Pl is "0", the data of the signal WEG is directly selected; when it is "1", the data multiplied with "−1" is outputted as the signal WD1.

Figure 4:
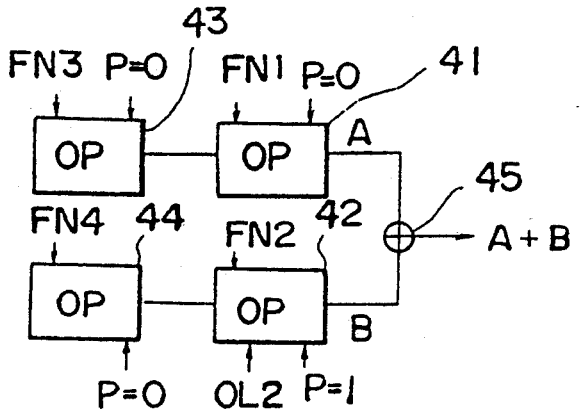
FIG. 4 is a block diagram of a musical tone generation apparatus according to another embodiment of the present invention.

FIG. 4 is a block diagram of a musical tone generation apparatus according to another embodiment of the present invention. This apparatus comprises FM operators 41 and 42 serving as carrier generators, and FM operators 43 and 44 serving as modulators. The outputs from the FM operators 41 and 42 are added by an adder 45, and the sum is outputted.

Assume that, in this parallel dual-carrier algorithm, the respective operators have equivalent basic parameters, and a ratio of frequency numbers FN1 to FN4 to be inputted to the operators 41 to 44 is set to be FN1 : FN2=FN3 : FN4 =2 : 1 and FN1: FN3=1 : 1, only the output from the operator 42 is inverted, and an output level of the operator 42 is properly controlled by a signal OL2. In this case, (2 m)th harmonic overtones (m=1, 2,. . . ) of a musical tone spectrum outputted from the operator 41 can be controlled.

Figure 5A:
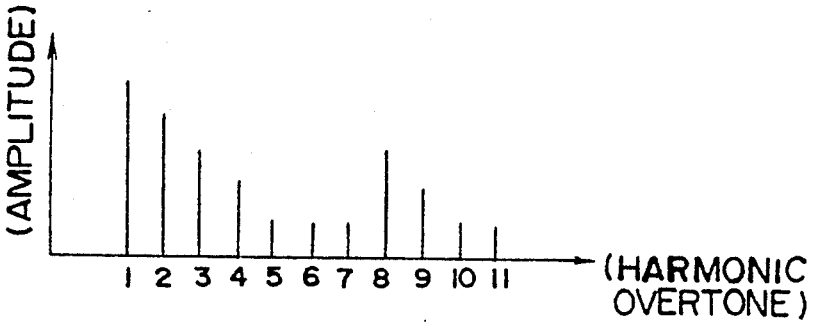
FIGS. 5*a* and 5*b* are explanatory views showing outputs of the apparatus shown in FIG. 4.
Figure 5B:
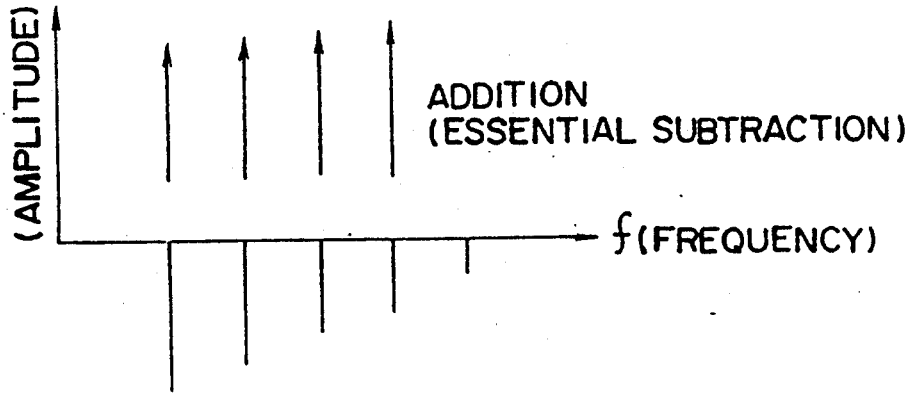

FIGS. 5*a* and 5*b* show this state, and respectively illustrate spectrum distributions of musical tone waveforms A and B outputted from the operator 41 and 42. Upon comparison with a spectrum distribution of a non-inverted output A, in a spectrum distribution of an output B which is inverted and whose frequency number is twice a series of the operator 41, the level is inverted, and the spectrum appears in correspondence with (2 m)th harmonic overtones of an output A. Therefore, in a waveform A+B obtained by adding musical tone waveforms A and B by the adder 45, the (2 m)th harmonic overtones in the musical tone waveform A are canceled by the corresponding levels of the musical tone waveform B. More specifically, an effect of filtering the (2 m)th harmonic overtones of the musical tone waveform A can be obtained.

In this manner, when the frequency ratios of two systems are appropriately selected, various harmonic overtone adjustments can be attained, and various changes in tone color can be obtained.

FIGS. 6*a* to 6*d* are explanatory views showing an example for obtaining a PWM waveform.

As is well known, in simple frequency modulation, when a frequency ratio of a modulator to a carrier is set to be, e.g., 2 : 1, a musical tone from which odd-numbered harmonic overtones are omitted, i.e., a musical tone having a rectangular waveform can be obtained. It is not easy to obtain a musical tone having a PWM waveform using a conventional FM operator. However, it is known that when a feedback level is appropriately set in the above-mentioned carrier operator with a feedback system, a waveform output approximate to a sawtooth waveform (FIG. 6*a*) can be obtained (see, for example, FIG. 11 of Japanese Patent Publication No. Sho 61-20875). By utilizing this nature, and the above-mentioned output inversion, a PWM waveform can be easily obtained.

Figure 6A:
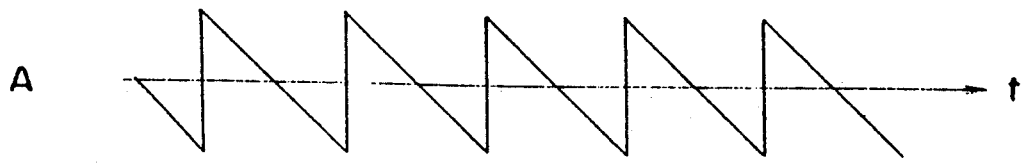
FIGS. 6*a* to 6*d* are explanatory views showing a state of synthesizing a PWM waveform in the apparatus shown in FIG. 4.
Figure 6B:
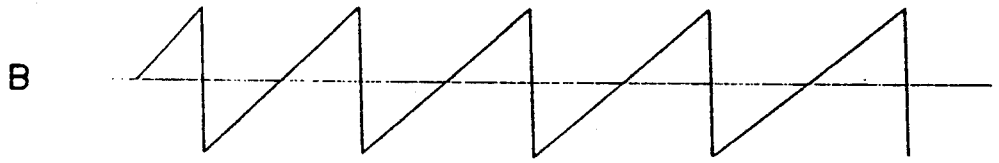
Figure 6C:
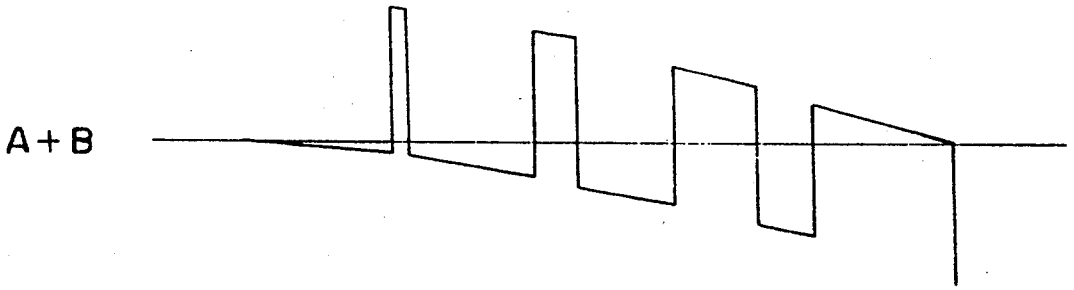
Figure 6D:
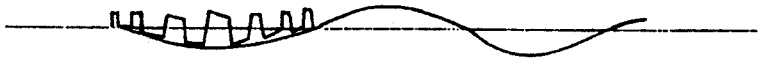

More specifically, in the arrangement shown in FIG. 4, for example, frequency numbers are set to be FN1: FN2=1 : +FN1 : FN3=1 : 1, and FN2 : FN4=1 : 1, so that sawtooth waveforms can be obtained from the two systems respectively, only the output of the operator 41 is inverted, the operators 41 and 42 respectively output waveforms A and B, as shown in FIGS. 6*a* and 6*b*, and a waveform A+B obtained by adding these waveforms is as shown in FIG. 6*c*. As can be seen from FIG. 6*d*, although pitch fluctuation components are added as offsets, a PWM waveform in which the PWM wave changes along these fluctuation components can be basically obtained.

In the above description, the FM algorithm with the simple parallel carrier arrangement has been exemplified. However, the present invention is not limited to this operator arrangement. If the output inverter function is utilized in algorithms as various combinations of a large number of operators, various musical tones can be synthesized.

With time-divisional multiplex processing, arithmetic operations and polyphonic processing of a large number of operators may be realized. A basic arrangement based on the time-divisional processing is already known to those who are skilled in the art in, e.g., Japanese Patent Publication Nos. Sho 64-4199, 63-22319, and the like.

In the above arrangement, an output inversion instruction (signal P) is statically set. Alternatively, the signal P may be appropriately changed in accordance with a key region, pitch, touch, and the like.

In the above arrangement, a final output of the operator is inverted by the output inverter. However, the sign of an output from the envelope generator may be inverted.

Furthermore, an output as an operator, and a signal to be fed back in the operator may independently have output inverters.

As described above, according to the present invention, since an output from an arbitrary FM operator can be inverted and outputted, various changes in tone color can be given to a musical tone signal obtained by adding outputs from respective operators.

For example, if sawtooth waveforms which are inverted to each other are set to be outputted as two outputs to be added by addition means, a PWM waveform can be obtained as a sum of these outputs. Since corresponding frequency components cancel each other, an operator can serve as a filter for a given frequency component of an output from another operator.

What is claimed is:

1. A musical tone synthesizing apparatus comprising:

circuitry means for generating a musical tone designation signal and an initial modulation signal;

a plurality of frequency modulation operators each including a waveform memory means for storing fundamental waveform data, and phase data generation means for generating a phase data address signal for accessing said waveform memory means on the basis of said musical tone designation signal and said modulation signal inputted from said circuitry means, said frequency modulation operators thereby producing an output waveform signal;

at least one of said plurality of frequency modulation operators further includes output inversion means for selecting whether said output waveform signal read out from said waveform memory in accordance with said phase data is outputted after sign inversion or is outputted directly; and connection control means for arbitrarily combining input and output connections of said plurality of frequency modulation operators, whereby at least one of said output waveform signals outputted from said output inversion means is inputted to at least one of said plurality of frequency modulation operators as at least one component of the modulation signal.

2. An apparatus according to claim 1, wherein the connections of said plurality of frequency modulation operators include one or more connections having addition means for adding output waveform signals from said frequency modulation operators and outputting a summation waveform signal.

3. An apparatus according to claim 1, wherein said connection control means combines output connections to add outputs from two of said frequency modulation operators, whereby one operator serves as a filter for specific harmonic overtones of said output waveform signal outputted from the other operator.

4. An apparatus according to claim 2, including first and second frequency modulation operators capable of outputting identical sawtooth output waveform signals, and wherein said first and second operators are connected by said addition means, and said output waveform signals from said first and second frequency modulation operators are inverted with respect to each other, the summation thereby obtaining a signal having a pulse width modulation waveform.

5. A musical tone synthesizing apparatus comrpising:

first memory means for storing waveform data;

first phase generating means for generating first phase data as a first address signal for accessing said first memory means;

first modulation means for receiving and modulating said first address signal based on a modulation signal inputted thereto;

first reading-out means for reading-out said waveform data from said first memory means according to said modulation first address signal, so that a first musical tone signal is generated;

first inverting means for arbitrarily inverting said first musical tone signal;

second memory for storing waveform data;

second phase generating means for generating second phase data as a second address signal for accessing said second memory means;

second reading-out means for reading-out said waveform data from said second memory means according to said second address signal, so that a second musical tone signal is generated; and adding means for adding said first musical tone signal inverted by said first inverting means and said second musical tone signal from said second reading out means to produce an output musical tone signal.

6. A musical tone synthesizing apparatus according to claim 5 further comprising second modulation means for modulating said second address signal based on a modulation signal inputted thereto, whereby said second reading-out means is responsive to said modulation second address signal.

7. A musical tone synthesizing apparatus according to claim 5 further comprising:

third memory means for storing waveform data;

third phase generating means for generating third phase data as a third address signal for accessing said third memory means; and, third reading-out means for reading-out said waveform data from said third memory means according to said third address signal, so that a third musical tone signal is generated;

wherein said third musical tone signal is inputted to said first modulation means as said modulation signal.

8. A musical tone synthesizing apparatus according to claim 6 further comprising:

third memory means for storing waveform data;

third phase generating means for generating third phase data as a third address signal for accessing said third memory means; and third reading-out means for reading-out said waveform data from said third memory means according to said third address signal, so that a third musical tone signal is generated, wherein said third musical tone signal is inputted to at least one of said first and second modulation means as said modulation signal.

9. A musical tone synthesizing apparatus according to claim 7 further comprising third inverting means for inverting said third musical tone signal.

10. A musical tone synthesizing apparatus according to claim 8 further comprising third inverting means for receiving and inverting said third musical tone signal from said third reading-out means.

11. A musical tone synthesizing apparatus according to claim 10 further comprising second inverting means for receiving and inverting said second musical tone signal from said second reading means.

12. A musical tone synthesizing apparatus comprising:

first memory means for storing waveform data;

first phase generating means for generating first phase data as a first address signal for accessing said first memory means;

first modulation means for receiving and modulating said first address signal based on a modulation signal inputted thereto;

first reading-out means for reading-out said waveform data from said first memory means according to said modulation first address signal, so that a first musical tone signal is generated;

first inverting means for arbitrarily inverting said first musical tone signal; and first feeding back means for feeding said arbitrarily inverted first musical tone signal from said first inverting means back to said first modulating means as said modulation signal.

13. A musical tone synthesizing apparatus according to claim 12 further comprising controlling means for controlling a level of said first musical tone signal fed back to said first modulating means.

14. A musical tone synthesizing apparatus according to claim 12 further comprising:

second memory means for storing waveform data;

second phase generating means for generating second phase data as a second address signal for accessing said second memory means;

second modulation means for modulating said second address signal based on a modulation signal inputted thereto;

second reading-out means for reading-out said waveform data from said second memory means according to said modulation second address signal, so that a second musical tone signal is generated;

second inverting means for arbitrarily inverting said second musical tone signal;

second feeding back means for feeding said second musical tone signal inverted by said second inverting means back to said second modulating means as said modulation signal; and, adding means for adding said first musical tone signal arbitrarily inverted by said first inverting means and said second musical tone signal arbitrarily inverted by said second inverting means.

15. A musical tone synthesizing apparatus according to claim 12 further comprising:

second memory means for storing waveform data;

second phase generating means for generating second phase data as a second address signal for accessing said second memory means;

second modulation means for modulating said second address signal based on a modulation signal inputted thereto;

second reading-out means for reading-out said waveform data from said second memory means according to said modulation second address signal, so that a second musical tone signal is generated;

second inverting means for arbitrarily inverting said second musical tone signal; and, second feeding back means for feeding said second musical tone signal arbitrarily by said second inverting means back to said second modulating means as said modulation signal, wherein said arbitrarily inverted second musical tone signal is also inputted to said first modulation means as a second modulation signal.

16. A musical tone synthesizing apparatus according to claim 15 further comprising:

third memory means for storing waveform data;

third phase generating means for generating third phase data as a third address signal for accessing said third memory means;

third modulation means for modulating said third address signal based on a modulation signal inputted thereto;

third reading-out means for reading-out said waveform data from said third memory means according to said modulation third address signal, so that a third musical tone signal is generated;

third inverting means for arbitrarily inverting said third musical tone signal;

third feeding back means for feeding said third musical tone signal arbitrarily inverted by said third inverting means back to said third modulating means as said modulation signal; and, adding means for adding said first musical tone signal arbitrarily inverted by said first inverting means and said second musical tone signal inverted by said seconds inverting means to send third musical tone signal arbitrarily inverted by said third inverting means.

17. A musical tone synthesizing apparatus according to claim 5 wherein said first inverting means comprises a multiplier for multiplying said waveform signal by a negative coefficient.

18. A musical tone synthesizing apparatus according to claim 12 wherein said first inverting means comprises a multiplier for multiplying said waveform signal by a negative coefficient.

* * * * *